US007905061B2

(12) United States Patent
Kaiser et al.

(10) Patent No.: US 7,905,061 B2
(45) Date of Patent: Mar. 15, 2011

(54) WIND SPOILER FOR ROOFS

(75) Inventors: Bruce A. Kaiser, Clearwater, FL (US); James R. Oldham, Woodstock, VT (US)

(73) Assignee: Lightning Master Corporation, Clearwater, FL (US)

( * ) Notice: Subject to any disclaimer, the term of this patent is extended or adjusted under 35 U.S.C. 154(b) by 693 days.

(21) Appl. No.: 11/598,303

(22) Filed: Nov. 13, 2006

(65) Prior Publication Data

US 2007/0113489 A1 May 24, 2007

Related U.S. Application Data

(60) Provisional application No. 60/735,954, filed on Nov. 10, 2005.

(51) Int. Cl.
*E04D 13/00* (2006.01)
*E04D 13/15* (2006.01)
*E04B 7/16* (2006.01)

(52) U.S. Cl. ..... 52/84; 52/94; 52/11; 244/199.4

(58) Field of Classification Search ..... 52/24, 84, 52/90.1, 94, 11, 97; 244/199.4; 343/DIG. 1, 343/713

See application file for complete search history.

(56) References Cited

U.S. PATENT DOCUMENTS

| | | | | |
|---|---|---|---|---|
| 224,520 | A | | 2/1880 | Dougherty |
| 390,061 | A | | 9/1888 | Bower |
| 417,270 | A | | 12/1889 | Nelson |
| 431,463 | A | | 7/1890 | Hewitt |
| D22,832 | S | | 10/1893 | Bryant |
| 507,776 | A | | 10/1893 | Berger et al. |
| 633,622 | A | | 9/1899 | Souther |
| 701,376 | A | | 6/1902 | Noel |
| 706,684 | A | | 8/1902 | Peter |
| 974,722 | A | | 11/1910 | Swanson |
| 1,085,474 | A | | 1/1914 | Peterson |
| 1,230,363 | A | | 6/1917 | Baird |
| 1,576,656 | A | | 11/1924 | Honsinger |
| 1,878,126 | A | | 9/1932 | Gates |
| 2,021,929 | A | | 11/1935 | Voigt |
| 2,206,040 | A | | 7/1940 | Ludington |
| 2,270,537 | A | | 1/1942 | Ludington |
| 2,270,538 | A | * | 1/1942 | Ludington ..... 52/15 |
| 2,306,080 | A | | 12/1942 | Peles |
| 2,841,100 | A | * | 7/1958 | Moller ..... 210/474 |
| 2,905,114 | A | | 9/1959 | Olson |
| 3,133,321 | A | | 5/1964 | Hine |
| 3,280,524 | A | | 10/1966 | Hull |
| 3,583,113 | A | | 6/1971 | Winski |
| 3,717,968 | A | | 2/1973 | Olsen et al. |
| 3,742,668 | A | | 7/1973 | Oliver |
| 3,866,363 | A | | 2/1975 | King |
| 3,969,850 | A | | 7/1976 | Hirai |
| 4,005,557 | A | | 2/1977 | Kramer et al. |

(Continued)

FOREIGN PATENT DOCUMENTS

JP 3547998 B2 7/1994

(Continued)

*Primary Examiner* — Khoi Tran
*Assistant Examiner* — Jason Holloway
(74) *Attorney, Agent, or Firm* — Gray Robinson, P.A.

(57) ABSTRACT

A wind spoiler including a vertical member mounted vertically along a roof of a structure to extend above the plane of the roof for creating turbulence in wind flowing over the roof.

12 Claims, 9 Drawing Sheets

U.S. PATENT DOCUMENTS

| | | | | |
|---|---|---|---|---|
| 4,032,456 | A * | 6/1977 | Berce | 210/474 |
| 4,233,786 | A | 11/1980 | Hildreth | |
| 4,351,134 | A * | 9/1982 | Clarkson | 52/12 |
| 4,461,129 | A | 7/1984 | von Platen | |
| 4,665,667 | A | 5/1987 | Taylor et al. | |
| 4,709,518 | A * | 12/1987 | Lane | 52/94 |
| 4,830,315 | A | 5/1989 | Presz, Jr. et al. | |
| 4,957,037 | A | 9/1990 | Tubbesing et al. | |
| 5,050,489 | A | 9/1991 | Mankowski | |
| 5,095,666 | A * | 3/1992 | Williams, Jr. | 52/11 |
| 5,272,846 | A | 12/1993 | Kelley et al. | |
| 5,321,921 | A | 6/1994 | Holt | |
| 5,414,965 | A | 5/1995 | Kelley et al. | |
| D361,138 | S | 8/1995 | Moore et al. | |
| 5,454,519 | A | 10/1995 | Luck | |
| 5,522,185 | A | 6/1996 | Cline | |
| 5,619,827 | A * | 4/1997 | Church | 52/60 |
| 5,724,776 | A | 3/1998 | Meadows, Jr. | |
| 5,735,035 | A | 4/1998 | Holt | |
| 5,813,179 | A | 9/1998 | Koenig, Jr. et al. | |
| 5,918,423 | A | 7/1999 | Ponder | |
| 6,044,601 | A | 4/2000 | Chmela et al. | |
| 6,128,865 | A | 10/2000 | Din | |
| 6,182,399 | B1 * | 2/2001 | Pollera | 52/11 |
| 6,202,372 | B1 | 3/2001 | Powell | |
| 6,212,836 | B1 | 4/2001 | Larson | |
| 6,240,679 | B1 * | 6/2001 | Smalara | 52/16 |
| 6,269,593 | B1 | 8/2001 | Thompson | |
| D451,204 | S | 11/2001 | Schlichting et al. | |
| 6,314,685 | B1 * | 11/2001 | Sullivan | 52/12 |
| 6,360,504 | B1 | 3/2002 | Webb | |
| 6,539,675 | B1 | 4/2003 | Gile | |
| 6,601,348 | B2 | 8/2003 | Banks et al. | |
| 6,606,828 | B1 | 8/2003 | Lin et al. | |
| 6,786,015 | B2 | 9/2004 | Wilt | |
| 6,877,282 | B2 | 4/2005 | Melsen et al. | |
| 6,941,706 | B2 | 9/2005 | Austin et al. | |
| 7,137,224 | B2 | 11/2006 | Rasmussen | |
| 7,174,677 | B1 | 2/2007 | Dressler | |
| D544,612 | S | 6/2007 | Cochrane | |
| 7,451,572 | B1 | 11/2008 | Inzeo et al. | |
| 2001/0027625 | A1 | 10/2001 | Webb et al. | |
| 2002/0040555 | A1 | 4/2002 | Banks et al. | |
| 2002/0050104 | A1 | 5/2002 | Reeves et al. | |
| 2002/0073633 | A1 | 6/2002 | Schlichting et al. | |
| 2002/0083666 | A1 | 7/2002 | Webb et al. | |
| 2002/0124485 | A1 | 9/2002 | Pulte | |
| 2003/0005649 | A1 | 1/2003 | Austin et al. | |
| 2005/0210759 | A1 | 9/2005 | Austin et al. | |
| 2005/0257443 | A1 | 11/2005 | Lin | |
| 2006/0016130 | A1 * | 1/2006 | Lin | 52/24 |
| 2006/0075694 | A1 * | 4/2006 | Lin | 52/94 |
| 2006/0248810 | A1 * | 11/2006 | Ewing | 52/84 |
| 2007/0113489 | A1 | 5/2007 | Kaiser et al. | |
| 2007/0193135 | A1 | 8/2007 | VandenBerg | |
| 2008/0005985 | A1 * | 1/2008 | Lin | 52/272 |

FOREIGN PATENT DOCUMENTS

| | | | |
|---|---|---|---|
| JP | 11-336276 | A | 12/1999 |
| JP | 2000008326 | | 1/2000 |

* cited by examiner

FIG. 1
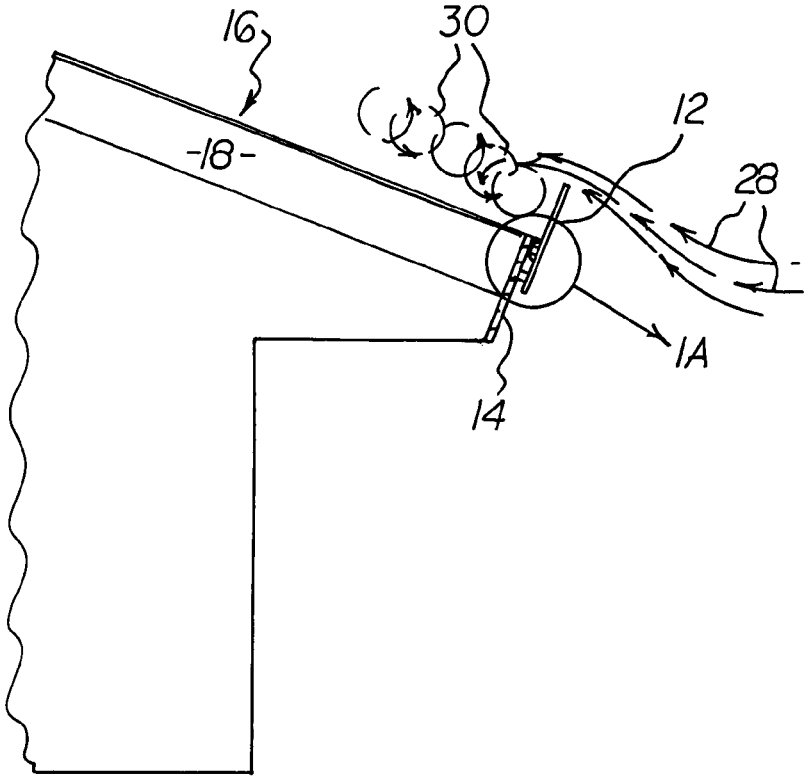
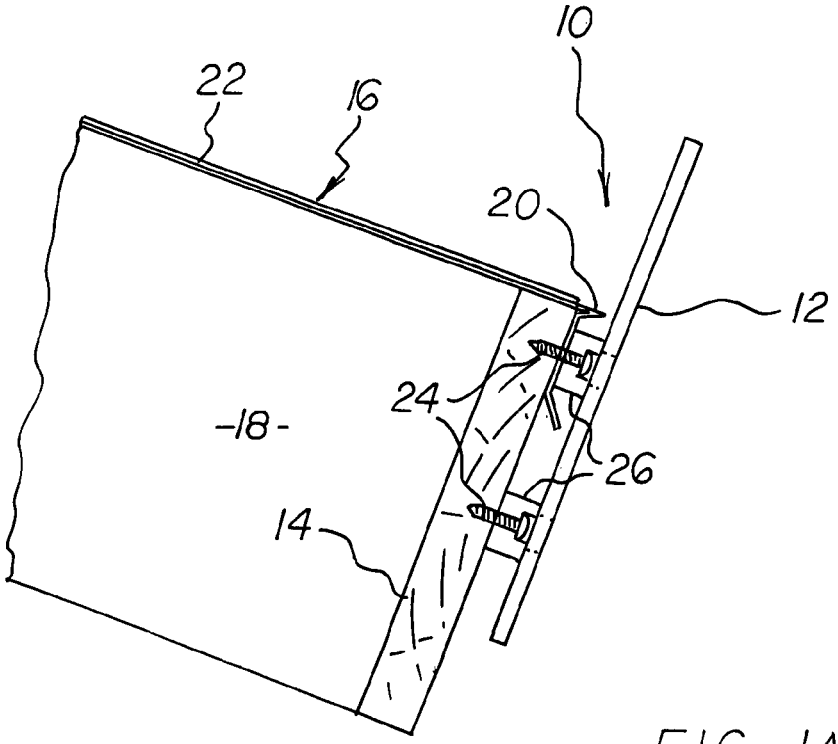
FIG 1A

16
Roofing Shingles
Wind Spoiler
10
32
22
36
34
Deployed
Drip Edge
14
38
20
Roof
Facia Spring Loaded Hinge
42
40AF
40A
40BF
40B
20
14
Roofing Shingles
22
Drip Edge
Roof
18
38
34
Stowed
32
14
Facia Wind Spoiler
36
10

FIG 4A
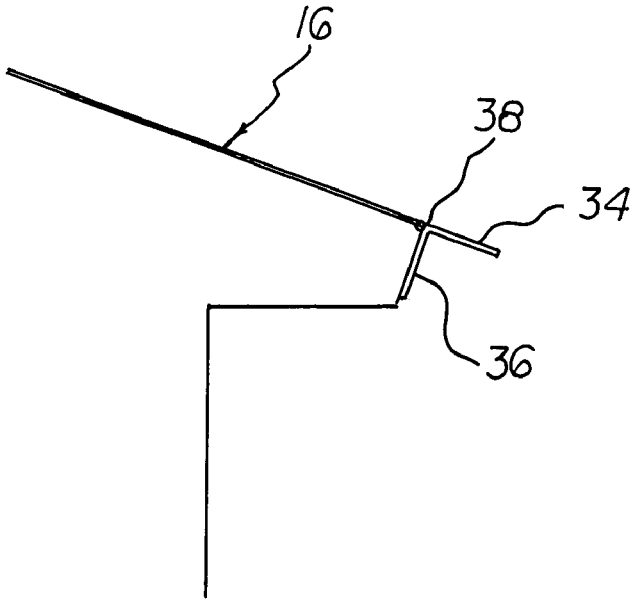
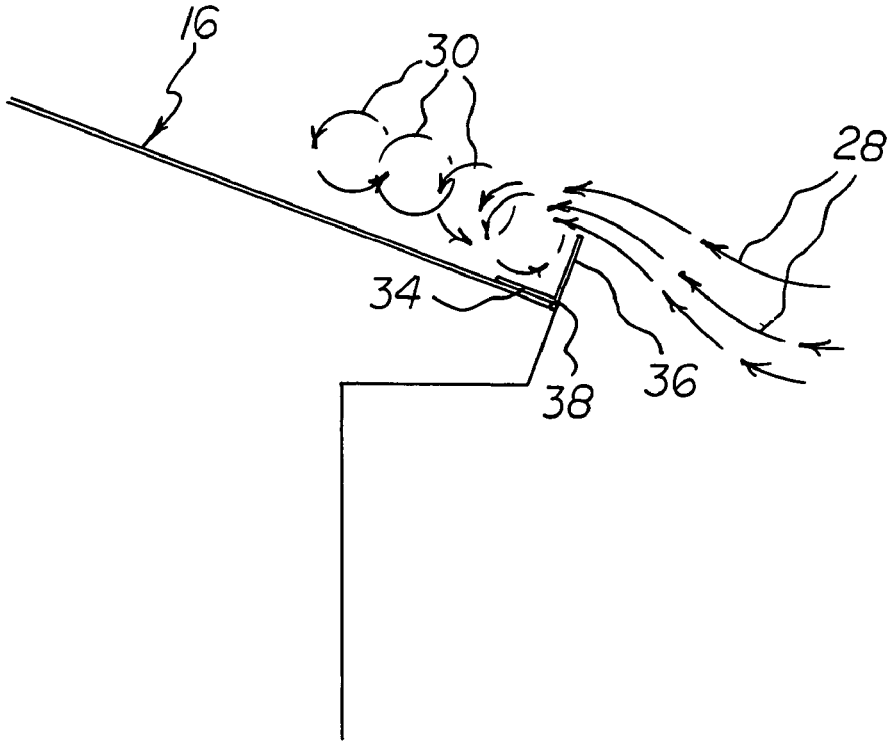
FIG 4B

WIND SPOILER FOR ROOFS

CROSS-REFERENCE TO RELATED APPLICATIONS

This application claims the benefit of provisional application No. 60/735,954, filed Nov. 10, 2005, the disclosure of which is incorporated by reference herein.

BACKGROUND OF THE INVENTION

1. Field of the Invention

This invention relates to roofing systems. More particularly, this invention relates to an apparatus and method for reducing the likelihood that a roof may be damaged by hurricane-force winds.

2. Description of the Background Art

One of the most devastating types of damage that can occur to a structure is the loss of its roof. During a hurricane or other wind event, wind forcibly flows under a roof and often causes the shingles to peel off. Further, structural damage to the roof itself is likely to occur. Once the shingles are peeled from the roof and the roof suffers structural damage, water intrusion occurs, ruining both the structure and its contents.

The roof of a building is a large lifting surface similar to an airplane wing. As such, wind blowing against a building must flow further to go over the roof of the building than it would otherwise flow along the surface of the earth. Therefore, the wind flowing over the roof accelerates and creates a low-pressure area over the roof. The wind flowing over the roof therefore tends to not only lift the roof and shingles both by shear catching the edge of the shingles or the plywood of the roof along the bottom and sides of the roof, but also tends to lift the roof structure off the supporting roof joists due to the low-pressure created over the roof as the wind flows over the roof.

Prior art solutions have included various clips or braces that reinforced the edges of the shingles to the roof or mechanically reinforced the roof to the roof joists. However, the prior art clips and braces do not eliminate the cause of the problem; namely, they fail to eliminate the low pressure area on the roof as the wind flows over the roof.

Therefore, it is an object of this invention to provide an improvement which overcomes the aforementioned inadequacies of the prior art devices and provides an improvement which is a significant contribution to the advancement of the roof protection art.

Another object of the invention is to provide an apparatus and method for reducing the likelihood of roof damage in the event of high winds such as a hurricane.

Another object of the invention is to provide an apparatus and method for disrupting the airflow across a roof during high winds so as to reduce the low pressure lifting force that would otherwise be exerted on the roof by the high winds.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a wind spoiler that reduces the low pressure area above a roof that occurs as wind flows over the roof, thereby significantly reducing the likelihood that a roof may be damaged by hurricane-force winds.

The wind spoiler of the invention is an up-standing elongated member that is fastened along the roof line to extend upwardly above the edge of the roof. The elongated member functions as a "wind spoiler" to aerodynamically disrupt or "spoil" the air flow over the roof during high winds conditions. Once the air flow is spoiled, the low pressure area that would otherwise occur as the wind flows over the roof is significantly reduced. The reduction of the low pressure area therefore substantially reduces the lifting force on the roof as air flows over the roof. The likelihood of the wind peeling back the shingles or otherwise causing structural damage to the roof is therefore significantly reduced or eliminated altogether.

The preferred configuration of the wind spoiler of the invention comprises an L-shaped configuration that is hingely connected to the edge of the roof along the roof line. In its stowed, at rest position, one leg of the L-shaped wind spoiler lays horizontally in alignment with and extending away from the roof line whereas the other leg lies vertically downward against the roof fascia. It is deployed position, the wind spoiler is flipped-back onto the shingles (i.e., rotated on its hinges 180 degrees) such that the horizontal leg is now facing the other direction toward the apex of the roof to lay on top of the leading edge of the shingles and such that the other leg is now extending vertical upward. Thus, in this deployed position, the vertical leg extends above the edge of the roof line to disrupt or spoil the flow of air over the roof thereby significantly reducing the creation of a low pressure area over the roof that would otherwise occur if the air flow was not disrupted. Moreover, in the deployed position, the horizontal leg overlaps the leading edge of the shingles thereby significantly reducing the likelihood of air flowing under the edge of the shingles and peeling them back.

The hinges employed to fasten the wind spoiler to the edge of the roof line function to hang in its stowed position due to gravity during low or no wind conditions and to then automatically to rotate from its stowed position to its deployed position during windy conditions. More particularly, during increasing wind conditions, air flows under and over the horizontally-disposed leg such that, as the wind speed increases, the wind spoiler is forcibly rotated via its hinges to flip back from its stored position to its deployed position.

An important aspect of the preferred embodiment of the wind spoiler of the invention is the fact that the harder the wind blows, the more firmly the horizontal leg presses down on the leading edge of the shingles while in the deployed position to prevent the wind from peeling back the shingles. Similarly, the harder the wind blows, the more the air flow is disrupted by the vertical leg to minimize the likelihood that a damaging low pressure area would be created over the roof.

Another important aspect of the preferred embodiment of the wind spoiler of the invention is the fact that as the wind speed decreases, the spoiler will return to its stowed position by the force of a spring acting on the hinge.

The wind spoiler of the invention may be employed even if a gutter is installed. Advantageously, the vertical leg of the wind spoiler may simply nest inside the gutter and the horizontal leg may simply overhang the gutter to urge leaves and other large debris fall clear of the gutter. Further, the gap between in the horizontal leg and the soffit allows rain flowing off the roof to flow through the gap into the gutter.

Installation of the wind spoiler of the invention is fast and easy. Wind spoiler sections (e.g., 4 foot lengths) are simply attached to the soffit using the above-mentioned hinges, preferably spaced along the fascia in alignment with the roof joists of the roof structure. If a gutter is installed, notches may be cut into the wind spoiler to provide clearance for the gutter supports. Once installed, the wind spoiler of the invention therefore aesthetically appears to be a natural part of the roof edge.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 1 is a side cross-sectional view of a fixed embodiment of the wind spoiler of the invention mounted to the fascia of the roof;

FIGS. 4A and 4B are schematic diagrams of the hinged embodiment of the wind spoiler of FIGS. 2 and 3 schematically showing stowed and deployed positions of the wind spoiler, respectively;

Similar reference characters refer to similar parts throughout the several views of the drawings.

DETAILED DESCRIPTION OF THE PREFERRED EMBODIMENT

Figures 2, 3:
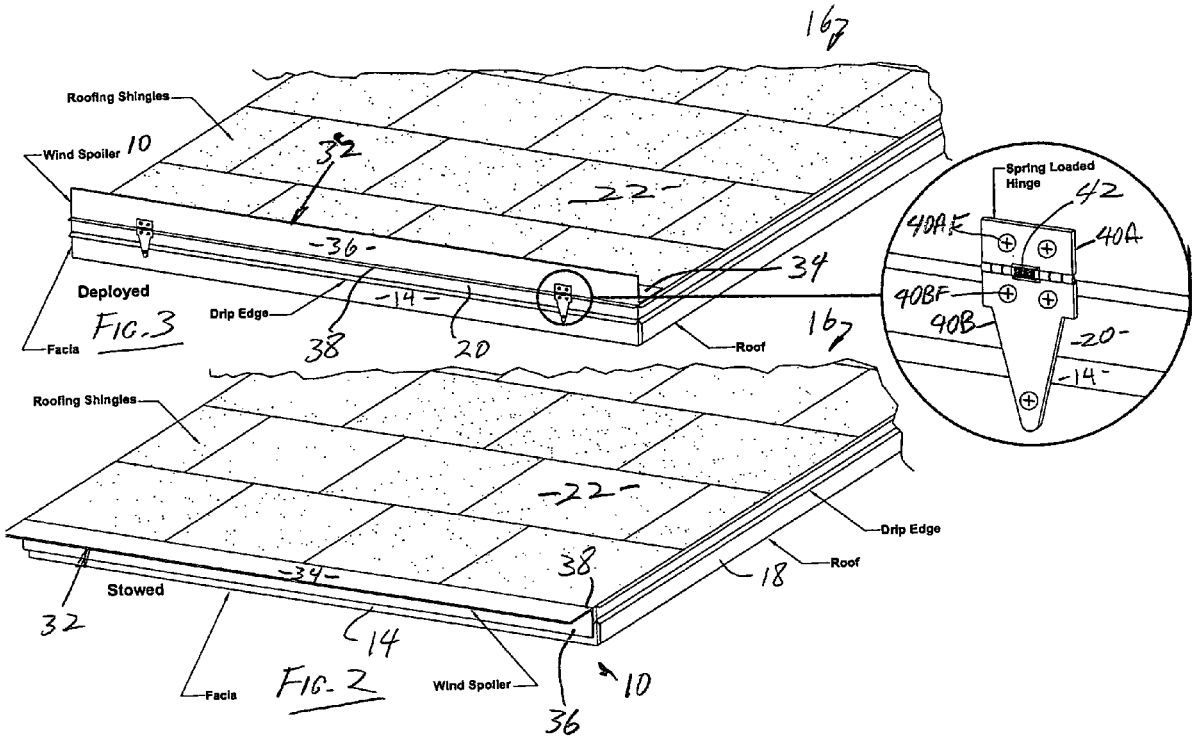
FIG. 2 is a partial perspective view of the hinged embodiment of the wind spoiler of the invention in its at-rest or stowed position along the leading edge of a roof.
FIG. 3 is a partial perspective view of the hinged embodiment of the wind spoiler of the invention of FIG. 2 forcibly moved to its raised or deployed position by high winds.

Referring to FIG. 1, the fixed embodiment of the wind spoiler 10 of the invention comprises a generally flat elongated vertical member 12 that is mounted to the fascia 14 of a roof 16 to extend upwardly above the plane of the roof 16. More particularly, as shown in the partially-expanded view of FIG. 1, a plurality of roof joists 18 are provided to define the plane of the roof 16. The fascia 14 is then nailed to the leading edges of the roof joists 18. A drip edge 20 is then fitted over the uppermost edge of the fascia 14 to direct rainfall to drip from the drip edge 20 instead of the fascia 14 itself. Conventional roofing shingles 22 are installed on the upper surface of the roof 16, typically by nailing.

The vertical member 12 of the wind spoiler 10 of the invention is mounted to the fascia 14 by suitable fasteners such as screws 24. As shown, the vertical member 12 may be positioned slightly away from the drip edge 20 by means of stand-offs 26 so as to not interfere with the dripping of rainfall from the drip edge 20.

During high winds, wind flow 28 impacting the leading edge of the roof 16 is obstructed by the upstanding vertical member 12 that extends above the plane of the roof 16. Upon being disrupted, a significant amount of turbulence 30 is created in the wind flow 28 as it flows upwardly along the roof 16. Having disrupted or "spoiled" the wind flow 28, the turbulence 30 fails to create a lifting force on the surface of the roof 16 as would otherwise occur if the wind flow 28 was not disrupted or "spoiled" to create the turbulence 30.

Referring to FIGS. 2 and 3, a pivotable embodiment of the wind spoiler 10 of the invention comprises an elongated L-shaped member 32 defined by a horizontal leg 34 and a vertical leg 36 formed along bend 38. The L-shaped member 32 is pivotably mounted to the leading of the roof 16 by means of a plurality of hinges 40, one leaf 40A of which is fastened to the vertical leg 36 by fasteners 40AF or bonding and the other leaf 40B fastened to the fascia 14 by means of fasteners 40BF such that the L-shaped member 32 may pivot relative to its bend 38 about the uppermost leading edge of the roof 16 from a "stowed" positioned as shown in FIG. 2 to a "deployed" position as shown in FIG. 3.

More particularly, in its stowed position as shown in FIG. 2, the horizontal leg 34 of the L-shaped member 32 extends generally horizontally away from the roof 16 in a generally coplanar alignment with the plane of the roof 16. The vertical leg 38 extends generally vertically downward to lie against the fascia 14. Upon being moved 180 degrees from its stowed position as shown in FIG. 2 to its deployed position as shown in FIG. 3, the vertical leg 16 now extends vertically upwardly from the plane of the roof 16 and the horizontal leg 34 now extends toward the roof 16 to overlap the shingles 22 positioned along the leading edge of the roof 16. Thus, it should be appreciated that when the wind spoiler 10 of the invention is in its stowed position, the horizontal leg 34 is aesthetically coplanar with the plane of the roof 16 to allow leaves, rainfall, snow, etc. to run off of the roof 16 without obstruction. Further, it should be appreciated that when installed on pitched roofs 16, the weight of the horizontal leg 34 inherently, through the force of gravity, retains itself in its stowed position as shown in FIG. 2. However, the hinges 40 may include internal springs 42 to softly bias the L-shaped member 32 to its stowed position.

As shown in the schematic diagrams of FIGS. 4A and 4B, when the wind spoiler 10 is subjected to wind flow 28 along the edge of the roof 16, the wind flow 28 impacts and sucks the horizontal leg 34 of the L-shaped member 32 causing it to pivot 180 degrees from its stowed position to its deployed position as shown in FIG. 3. Upon the horizontal leg 34 being moved to its deployed position, the vertical leg 36 extends vertically above the plane of the roof 16 to obstruct the wind flow 28 and thereby create turbulence in the wind flow 28.

Consequently, as noted above in connection with the embodiment of FIG. 1, once turbulence 30 is created within the wind flow 28, the turbulence 30 does not allow the formation of suction above the roof 16 as would otherwise occur if no turbulence 30 would be imparted to the wind flow 28.

Figure 5A:
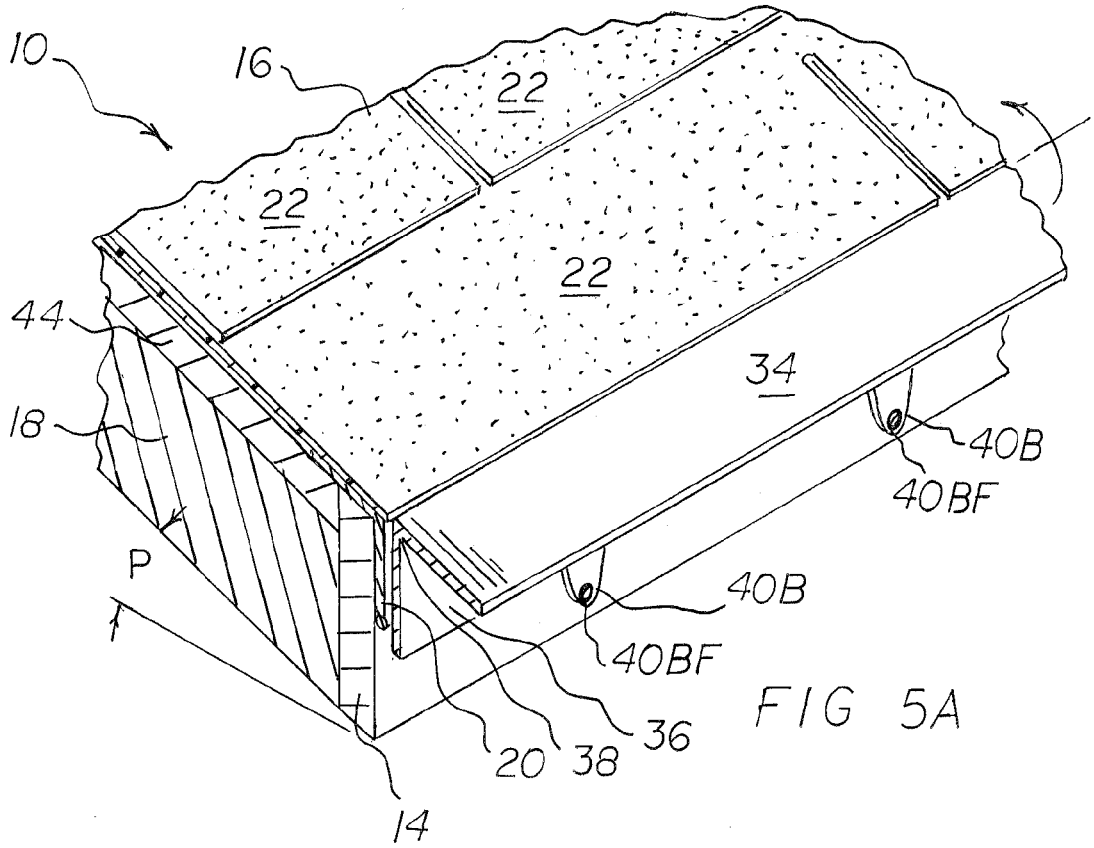
FIGS. 5A and 5B are partial cross-sectional views of the hinged embodiment of the wind spoiler of FIGS. 2 and 3 showing in more detail the manner in which it is mounted to the fascia of the roof.
Figure 5B:
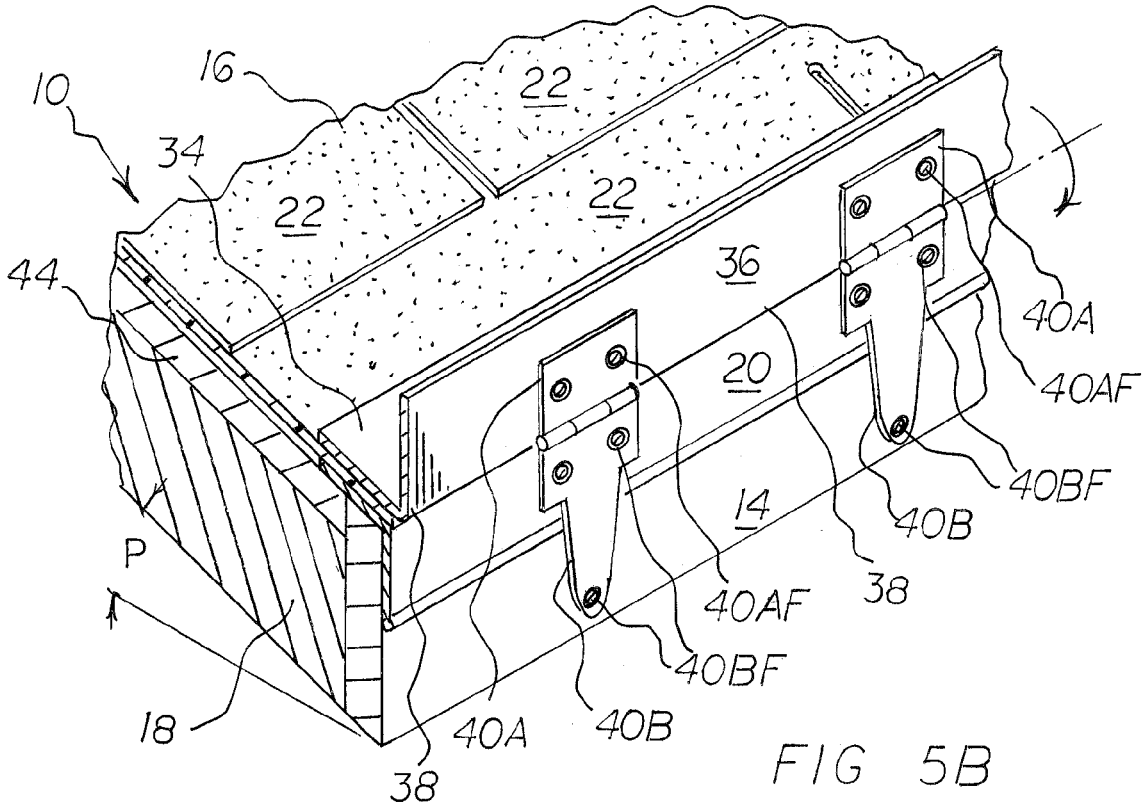

FIGS. 5A and 5B are partial cross-sectional views of the hinged embodiment of the wind spoiler 10 of FIGS. 2-4 showing in more detail the manner in which the wind spoiler 10 is mounted to the fascia 14 of the roof 16. More particularly, conventional roofs comprise a plurality of roof trusses having roof joists 18 at pitch "p" to which are nailed sheets of plywood 44 to cover all of the joists 18 and create the pitched, planar configuration of the roof 16. Fascia 14 is then nailed to the leading ends of the joists 18 to cover the edge of the plywood sheeting 44 and the joists 18 themselves. The drip edge 20 is affixed to the upper leading edge of the fascia 14 to cover the leading edge of the plywood sheeting 44 and to extend downwardly over the uppermost edge of the fascia 14. As noted above, fascia 20 typically include a horizontal bead or ridge that functions as a drip edge to direct rainfall to drip from the drip edge 20 rather than flowing onto the fascia 14. Asphalt shingles 22 are then affixed to the plywood sheeting 14, typically by roofing nails, extending from the leading edge of the roof 16 upwardly along the planar surface of the roof 16 in a progressively overlapping manner such that rainfall flowing down the roof flows off the shingles 22 without flowing under them.

The wind spoiler 10 of the invention is intended to be affixed along the upper leading edge of the roof 16 such that the bend 38 defining the horizontal and vertical legs 34 and 36 is generally parallel and aligned the upper leading edge of the roof 16. When so positioned, the horizontal leg 34 is generally coplanar with the shingles 22. Due to gravity or with the assistance of spring 42, the vertical leg 36 is urged to its downward vertical position adjacent the drip edge 20 and fascia 14.

Upon increasing wind flow 28 toward the leading edge of the roof 16, the wind spoiler 10 is forced to rotate 180 degrees against the force of gravity (and against the force of spring 42) from its stowed position of FIG. 5A to its deployed position as shown in FIG. 5B. When in its deployed position, the vertical leg 36 is now flipped vertically upwardly and the horizontal leg 34 is flipped to face toward the roof 16 and overlap the leading edge of the shingles 22. Consequently, in such deployed position, the upward vertical leg 36 functions to obstruct wind flow 28 flowing over the roof 16 and thereby create turbulence 30 within the air flow 28. Simultaneously, the horizontal leg 34 functions to hold down the leading edge of the shingles 22 such that wind flow 28 is prevented from getting in under the leading edge of the shingles 22 that would otherwise tend to peel the shingles 22 from the roof 16.

Figure 6:
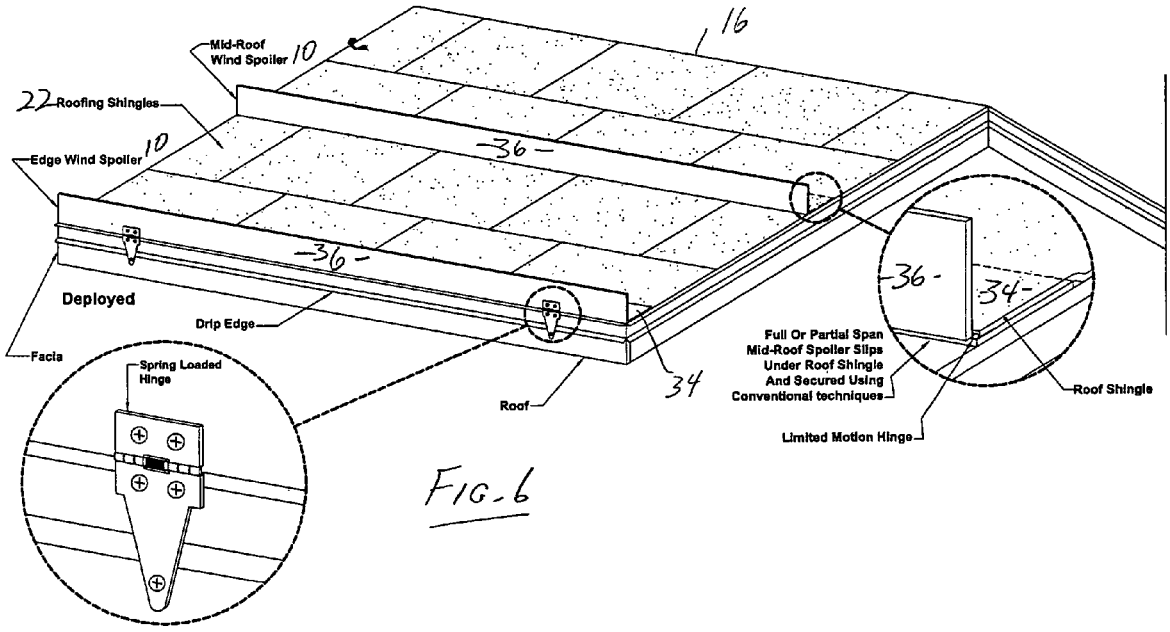
FIG. 6 is a perspective view showing wind spoilers of FIGS. 2 and 3, one mounted to the leading edge of the roof and the other mounted mid-way up the roof.

As shown in FIG. 6, one wind spoiler 10 of the invention may be positioned along the leading edge of the roof 16 as previously described. Additionally, however, one or more other wind spoilers 10 of the invention may be positioned further up the roof 16 such as midway up the roof 16 as shown in FIG. 6. The additional wind spoilers 10 of the invention mounted further up the roof 16 function to maintain or enhance the turbulence 30 to assure that a high level of turbulence 30 always exists along the planar surface of the roof 16 thereby precluding the formation of re-attachment of air flow on the roof 16.

Figures 7A, 7B, 7C, 7D:
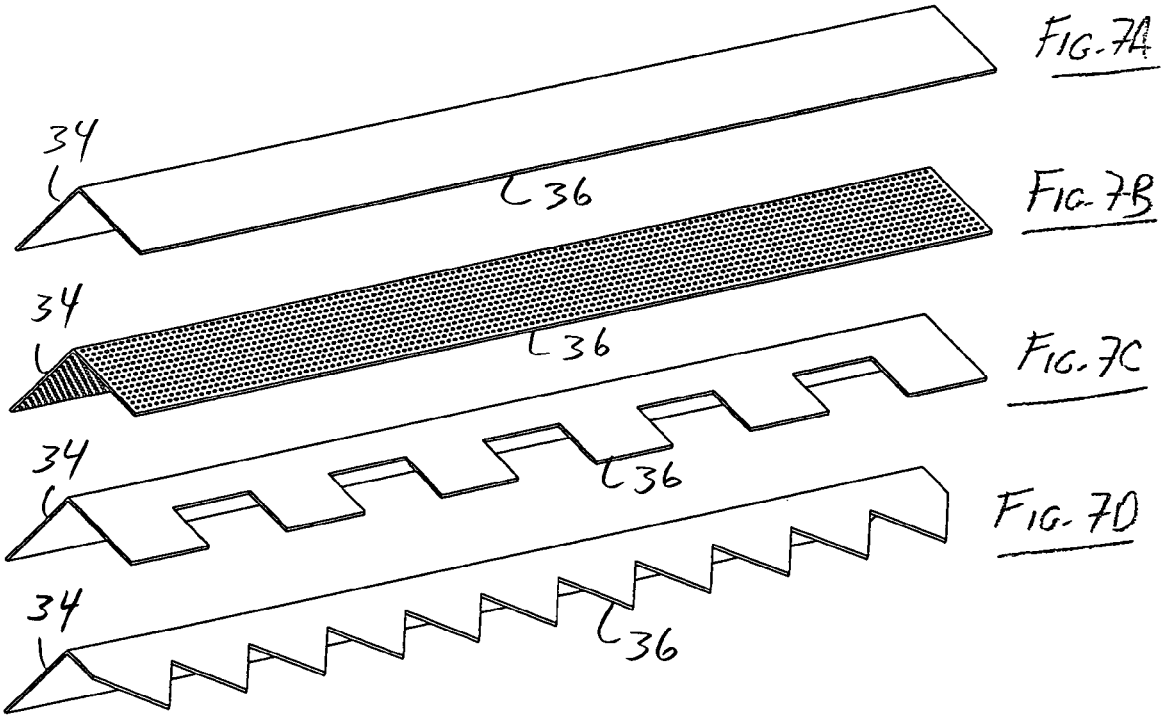
FIGS. 7A, 7B, 7C, and 7D are perspective views of different configurations of the wind spoiler of the invention.

As shown in FIGS. 7A, 7B, 7C and 7D, the vertical leg 36 of the wind spoiler 10 of the invention may comprise various embodiments. Specifically, as shown in FIG. 7A, the vertical leg 36 may comprise a generally rectangular configuration. In FIG. 7B, the vertical leg 36 may alternatively comprise a perforated configuration allowing some air flow 28 therethrough. Still alternatively, as shown in FIG. 7C, the vertical leg 36 may include crenellations. Finally, as shown in FIG. 7D, the vertical leg 36 may comprise a saw tooth configuration.

Figure 8:
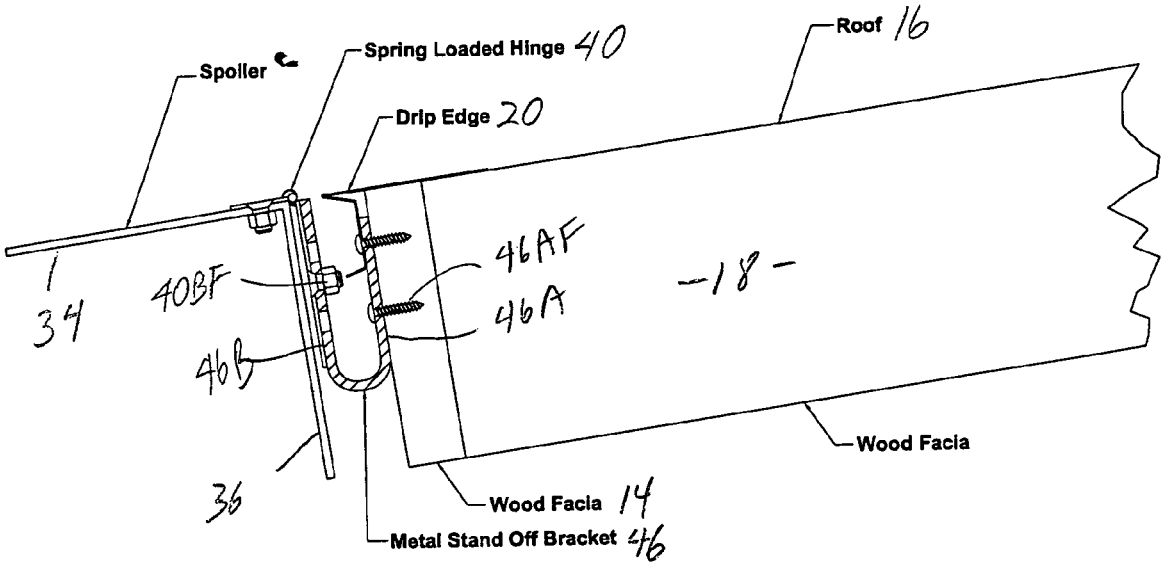
FIG. 8 is a perspective view of the wind spoiler of the invention mounted to the edge of the roof by a stand-off bracket.

FIG. 8 illustrates an alternative method for affixing the wind spoiler 10 of the invention to the fascia 14 of the roof 16. More particularly, a specially-configured standoff bracket 46 having a generally U-shaped configuration may be employed for affixing the wind spoiler 10 to the fascia 14. The standoff bracket 46 comprises one leaf 46A which is affixed to the fascia 14 by suitable fasteners 46AF and another leaf 46B that serves as a base to which the leaf 46B of the hinge 40 is affixed by means of fastener 46BF. As illustrated in FIG. 8, the standoff bracket 46 functions to position the wind spoiler 10 appreciably away from the drip edge 20. Without departing from the spirit and scope of this invention, the standoff bracket 46 may be integrally formed with the drip edge 20.

Figure 9:
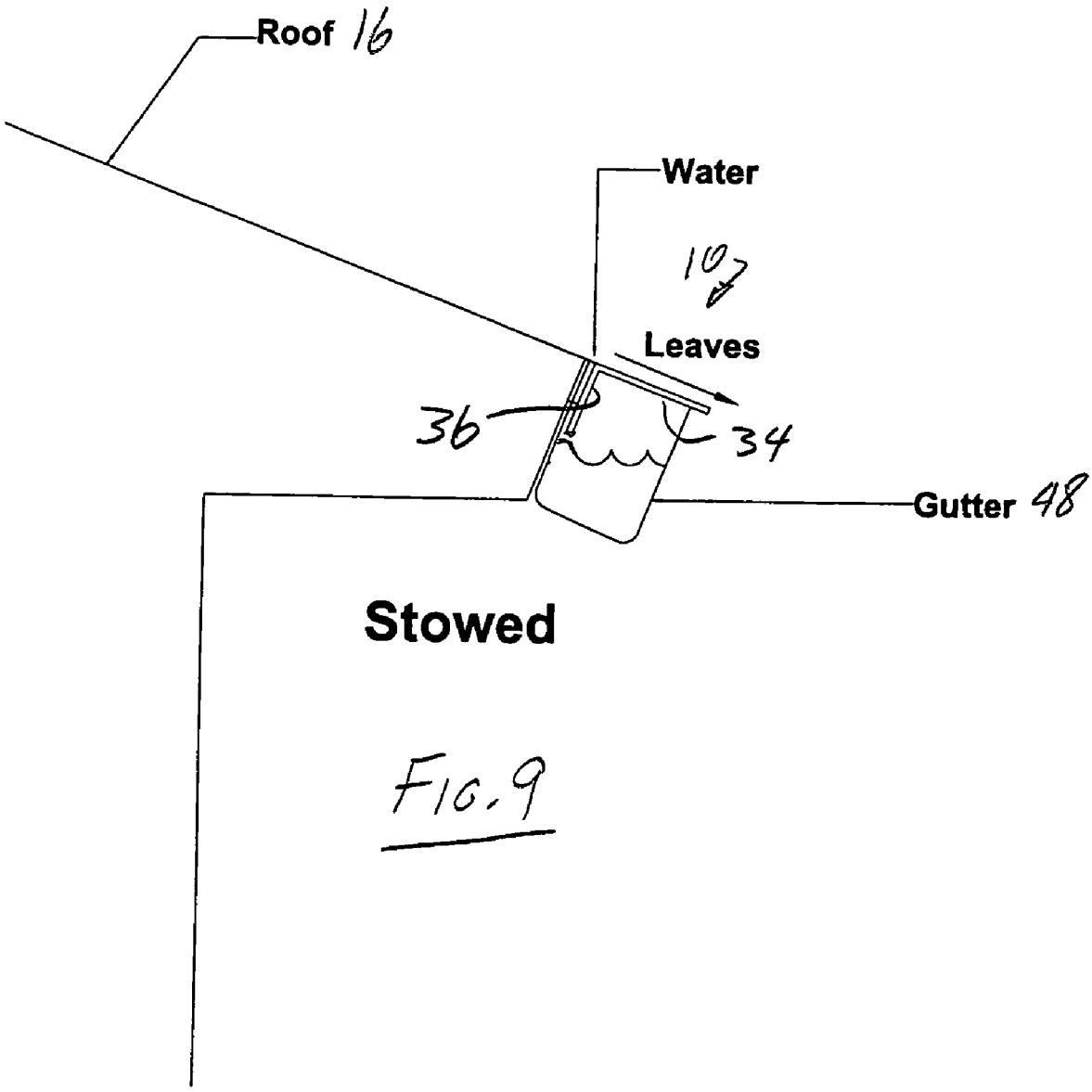
FIG. 9 is a schematic diagram of the wind spoiler of the invention mounted relative to a gutter installed along the edge of the roof.
Figure 10:
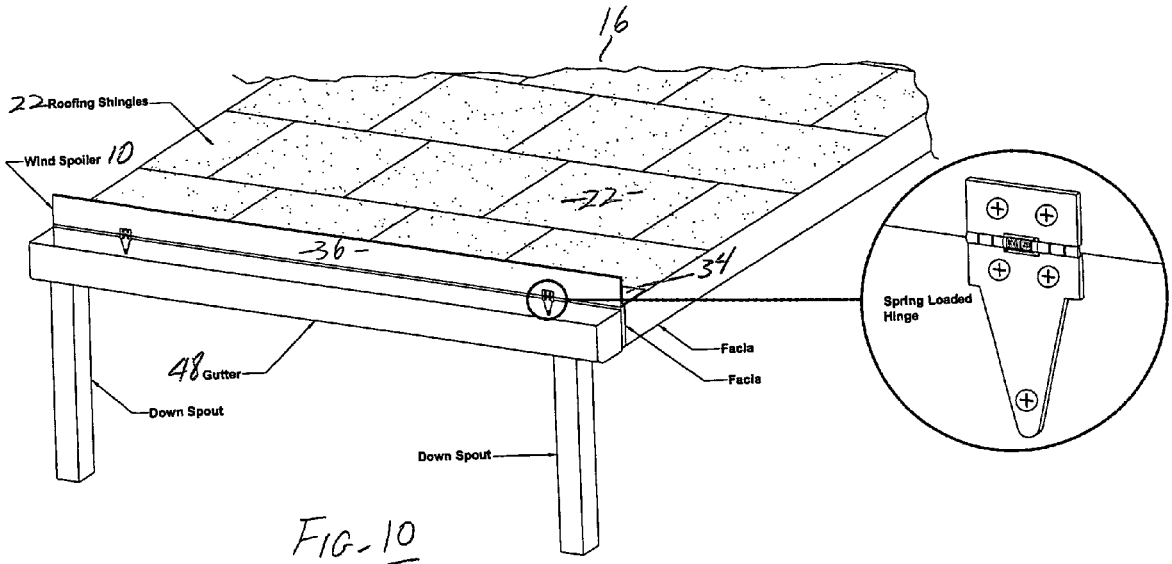
FIG. 10 is a perspective view showing the gutter-mounted wind spoiler of the invention in its deployed position.

Referring to FIGS. 9 and 10, the wind spoiler 10 of the invention may be incorporated within a conventional gutter 48 affixed to the leading edge of the roof 16. More particularly, as best shown in FIG. 9, the vertical leg 36 extends downwardly into the gutter 48 and the horizontal leg 34 extends over the gutter 48 when the wind spoiler 10 is in its stowed position. As shown in FIG. 10, as the wind flow 28 increases to move the wind spoiler 10 from its stowed position to its deployed position, the horizontal leg 34 is flipped back 180 degrees to overlap the roofing shingles 22 and the vertical leg 34 is extended 180 degrees from its downward vertical position to its upward vertical deployed position.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A wind spoiler system comprising in combination:

a roof having a plurality of overlapping shingles extending to a lower edge and a generally vertical fascia proximate to the lower edge;

a spoiler having a vertical member mounted vertically along the lower edge of the roof to extend above the plane of the roof and a horizontal member coupled to said vertical member in an L-shaped configuration along a longitudinal bend between said horizontal member and said vertical member; and a mechanism interconnecting said longitudinal bend and said fascia with said horizontal member and said vertical member being pivotably mounted relative to said fascia to pivot relative to said longitudinal bend, said mechanism including a stored position with said horizontal member extending horizontally away from the lower edge of the roof and the vertical member extending vertically downwardly generally parallel to said fascia and a deployed position with said horizontal member extending horizontally over said overlapping shingles along the lower edge of the roof and the vertical member extending vertically upwardly, whereby the force of wind flowing from the lower edge over the roof pivots the spoiler from said stored position to said deployed position to cover said overlapping shingles along the lower edge of the roof and to create turbulence in the wind flowing over the roof.

2. The wind spoiler system as set forth in claim 1, wherein said mechanism comprises at least one hinge having a hinge pin whose axis is positioned in parallel alignment with said longitudinal bend of said L-shaped configuration with one leaf coupled to the spoiler and another leaf connected relative to the fascia.

3. The wind spoiler system as set forth in claim 2, wherein said other leaf of said hinge connected relative to the fascia is directly connected to the fascia.

4. The wind spoiler system as set forth in claim 3, wherein said leafs are spring-loaded to urge the vertical member to its stored position.

5. The wind spoiler system as set forth in claim 1, further including a gutter having said vertical member of the spoiler extending therein when the spoiler is in its stored position.

6. The wind spoiler system as set forth in claim 5, wherein said horizontal member extends over an opened end of said gutter when the spoiler is in its stored position.

7. The wind spoiler system as set forth in claim 1, wherein said vertical member comprises a rectangular planar configuration.

8. The wind spoiler system as set forth in claim 1, wherein said vertical member comprises a perforated configuration.

9. The wind spoiler system as set forth in claim 1, wherein said vertical member comprises a castellated configuration.

10. The wind spoiler system as set forth in claim 1, wherein said vertical member comprises a saw-tooth configuration.

11. The wind spoiler system as set forth in claim 1, wherein said mechanism includes a stand-off bracket.

12. The wind spoiler system as set forth in claim 11, wherein said standoff bracket comprises a U-shaped configuration having one leaf to which said vertical member is connected and another leaf that is connected to the fascia.

* * * * *